US011005148B2

(12) United States Patent
Zhang et al.

(10) Patent No.: US 11,005,148 B2
(45) Date of Patent: May 11, 2021

(54) LIQUID CRYSTAL PHASE SHIFTER AND FABRICATION METHOD THEREOF, LIQUID CRYSTAL ANTENNA AND ELECTRONIC DEVICE

(71) Applicant: BOE TECHNOLOGY GROUP CO., LTD., Beijing (CN)

(72) Inventors: Pengju Zhang, Beijing (CN); Mingxing Liu, Beijing (CN); Hong Zhu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 16/382,502

(22) Filed: Apr. 12, 2019

(65) Prior Publication Data

US 2019/0319325 A1 Oct. 17, 2019

(30) Foreign Application Priority Data

Apr. 13, 2018 (CN) ..... 201810331979.9

(51) Int. Cl.
*H01P 1/18* (2006.01)
*H01P 11/00* (2006.01)
(Continued)

(52) U.S. Cl.
CPC ..... *H01P 1/181* (2013.01); *H01P 11/00* (2013.01); *H01Q 1/38* (2013.01); *H01Q 3/36* (2013.01); *H01Q 13/28* (2013.01)

(58) Field of Classification Search
None
See application file for complete search history.

(56) References Cited

U.S. PATENT DOCUMENTS 5,867,243 A * 2/1999 Engle ..... G02F 1/133308 349/158
6,175,401 B1 * 1/2001 Tanaka ..... G02F 1/1416 349/172

(Continued)

FOREIGN PATENT DOCUMENTS

CN 103975483 A 8/2014
CN 104466307 A 3/2015

(Continued)

OTHER PUBLICATIONS

Chinese Office Action in Chinese Application No. 201810331979.9, dated Jul. 13, 2020, with English translation.

*Primary Examiner* — Crystal L Hammond
(74) *Attorney, Agent, or Firm* — Collard & Roe, P.C.

(57) ABSTRACT

A liquid crystal phase shifter and a fabrication method thereof, a liquid crystal antenna and an electronic device are provided. The liquid crystal phase shifter includes a first substrate, a first substrate and a liquid crystal layer. The first substrate includes a first surface and a first electrode provided on the first surface, the second substrate includes a second surface and a second electrode provided on the second surface, the liquid crystal layer is provided between the first electrode of the first substrate and the second electrode of the second substrate, and the first substrate and the second substrate constitute a tubular structure in which the first substrate and the second substrate are stacked with one of the first substrate and the second substrate being inside the other of the first substrate and the second substrate.

17 Claims, 5 Drawing Sheets

(51) Int. Cl.

| | |
|---|---|
| ***H01Q 1/38*** | (2006.01) |
| ***H01Q 3/36*** | (2006.01) |
| ***H01Q 13/28*** | (2006.01) |

(56) References Cited

U.S. PATENT DOCUMENTS

| | | | | |
|---|---|---|---|---|
| 6,504,592 | B1 * | 1/2003 | Takatori | G02F 1/133707 349/111 |
| 8,237,545 | B2 * | 8/2012 | Watanabe | G01D 21/00 340/10.1 |
| 2001/0017577 | A1 | 8/2001 | Toko et al. | |
| 2014/0118647 | A1 * | 5/2014 | Momonoi | G02B 30/27 349/33 |
| 2014/0266897 | A1 | 9/2014 | Jakoby et al. | |
| 2015/0378196 | A1 * | 12/2015 | Ochiai | G02F 1/1339 349/123 |
| 2016/0195742 | A1 * | 7/2016 | Kim | G02F 1/133788 349/33 |
| 2020/0089042 | A1 | 3/2020 | Cao et al. | |

FOREIGN PATENT DOCUMENTS

| | | | |
|---|---|---|---|
| CN | 106654470 | A | 5/2017 |
| CN | 106684551 | A | 5/2017 |
| CN | 107453013 | A | 12/2017 |

* cited by examiner

LIQUID CRYSTAL PHASE SHIFTER AND FABRICATION METHOD THEREOF, LIQUID CRYSTAL ANTENNA AND ELECTRONIC DEVICE

The present application claims priority of Chinese Patent Application No. 201810331979.9 filed on Apr. 13, 2018, the disclosure of which is incorporated herein by reference in its entirety as part of the present application.

TECHNICAL FIELD

Embodiments of the present disclosure relate to a liquid crystal phase shifter and a fabrication method thereof, a liquid crystal antenna and an electronic device.

BACKGROUND

A phase shifter is a device that can modulate a phase of a wave, and is widely applied in fields such as a radar system, a mobile communication system and microwave measurement. When the phase shifter adjusts a circuit parameter, it may change a phase of a signal continuously or discontinuously without changing amplitude of the signal, that is, the signal may pass the phase shifter without distortion but only has the phase changed. An early phase shifter includes a mechanical analog phase shifter; and with development of technology, an electronic phase shifter emerges as the times require, and gradually develops into miniaturization and high integration.

In recent years, a liquid crystal phase shifter has been extensively and intensively studied as a new type of phase shifter. In the liquid crystal phase shifter, a liquid crystal material is used as a control medium, and an output phase is controlled by changing a microwave transmission constant. The liquid crystal phase shifter may be implemented based on a structural form such as a coaxial line structure or a waveguide structure, and has advantages such as a large phase shift degree, a low working voltage and a small volume, which is important for wireless communication intelligent networking and promoting a capacity of an existing wireless communication system.

SUMMARY

At least one embodiment of the disclosure provides a liquid crystal phase shifter, comprising: a first substrate, including a first surface and a first electrode provided on the first surface; a second substrate, including a second surface and a second electrode provided on the second surface; and a liquid crystal layer, provided between the first electrode of the first substrate and the second electrode of the second substrate, in which, the first substrate and the second substrate constitute a tubular structure in which the first substrate and the second substrate are stacked with one of the first substrate and the second substrate being inside the other of the first substrate and the second substrate.

For example, in the liquid crystal phase shifter provided by at least one embodiment of the disclosure, the first electrode is a microstrip line, and the second electrode is a ground electrode.

For example, in the liquid crystal phase shifter provided by at least one embodiment of the disclosure, the first electrode includes a plurality of folded line sub-portions or curved line sub-portions, and the plurality of folded line sub-portions or curved line sub-portions are uniformly distributed around a circular arc surface of the first substrate.

For example, in the liquid crystal phase shifter provided by at least one embodiment of the disclosure, the second substrate and the second electrode are integral into a metal tube.

For example, in the liquid crystal phase shifter provided by at least one embodiment of the disclosure, the second substrate and the second electrode are integral into a metal column, and the second substrate is provided inside the first substrate.

For example, in the liquid crystal phase shifter provided by at least one embodiment of the disclosure, the first substrate and/or the second substrate are flexible substrates.

For example, the liquid crystal phase shifter provided by at least one embodiment of the disclosure further comprises a plurality of spacers, in which, the spacers abut between the first substrate and the second substrate, and are distributed in the liquid crystal layer.

For example, the liquid crystal phase shifter provided by at least one embodiment of the disclosure further comprises a flexible sealant, in which, the flexible sealant is provided at both ends of the tubular structure and is located between the first substrate and the second substrate.

For example, in the liquid crystal phase shifter provided by at least one embodiment of the disclosure, the liquid crystal layer has a uniform thickness.

At least one embodiment of the disclosure provides an electronic device, comprising the liquid crystal phase shifter according to any one embodiment of the disclosure.

At least one embodiment of the disclosure provides liquid crystal antenna, comprising: a first substrate, including a first surface and a first electrode provided on the first surface; a second substrate, including a second surface and a second electrode provided on the second surface; a liquid crystal layer, provided between the first substrate and the second substrate; and a radiator portion, provided on the second substrate, in which, the first substrate and the second substrate constitute a tubular structure in which the first substrate and the second substrate are stacked with one of the first substrate and the second substrate being inside the other of the first substrate and the second substrate.

For example, in the liquid crystal antenna provided by at least one embodiment of the disclosure, the second electrode includes an opening, the opening overlaps with the first electrode in a direction perpendicular to a central axis of the tubular structure, and the first substrate is located inside the second substrate.

For example, in the liquid crystal antenna provided by at least one embodiment of the disclosure, the radiator portion overlaps with the opening.

For example, in the liquid crystal antenna provided by at least one embodiment of the disclosure, the opening overlaps with an output end of the first electrode in the direction perpendicular to the central axis of the tubular structure.

For example, in the liquid crystal antenna provided by at least one embodiment of the disclosure, the radiator portion is insulated from the second electrode.

For example, in the liquid crystal antenna provided by at least one embodiment of the disclosure, the radiator portion has a shape of a square, and a side length of the square is about half of a wavelength of a microwave signal transmitted by the liquid crystal antenna.

At least one embodiment of the disclosure provides an electronic device, comprising the liquid crystal antenna according to any one embodiment of the disclosure.

At least one embodiment of the disclosure provides a fabrication method of a liquid crystal phase shifter, comprising: providing a first substrate, wherein, a first electrode is formed on a first surface of the first substrate; providing a second substrate, wherein, a second electrode is formed on a second surface of the second substrate; and bonding the first substrate and the second substrate to form a liquid crystal cell of a tubular structure and filling a liquid crystal layer in the liquid crystal cell, in which, the liquid crystal layer is located between the first electrode and the second electrode.

For example, in the fabrication method provided by at least one embodiment of the disclosure, the bonding the first substrate and the second substrate to form the liquid crystal cell of the tubular structure and filling the liquid crystal layer in the liquid crystal cell includes: filling the liquid crystal layer between the first substrate and the second substrate and encapsulating the liquid crystal layer; and bending the liquid crystal cell formed by the first substrate, the second substrate and the liquid crystal layer into the tubular structure.

For example, in the fabrication method provided by at least one embodiment of the disclosure, the bonding the first substrate and the second substrate to form the liquid crystal cell of the tubular structure and filling the liquid crystal layer in the liquid crystal cell includes: bending the first substrate and the second substrate into the tubular structure in which the first substrate and the second substrate are stacked with one of the first substrate and the second substrate being inside the other of the first substrate and the second substrate; and filling the liquid crystal layer between the first substrate and the second substrate and encapsulating the liquid crystal layer.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
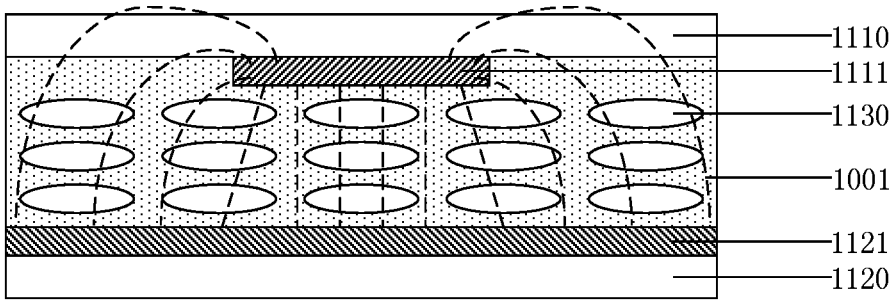
FIG. 1 is a cross-sectional schematic diagram of a liquid crystal phase shifter.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those ordinarily skilled in the art can obtain other embodiment(s), without any inventive work, which should be within the scope of the present disclosure.

Unless otherwise specified, the technical terms or scientific terms used in the present disclosure should be of general meaning as understood by those ordinarily skilled in the art. In the present disclosure, words such as "first", "second" and the like do not denote any order, quantity, or importance, but rather are used for distinguishing different components. Words such as "include" or "comprise" and the like denote that elements or objects appearing before the words of "include" or "comprise" cover the elements or the objects enumerated after the words of "include" or "comprise" or equivalents thereof, not exclusive of other elements or objects. Words such as "connected" or "connecting" and the like are not limited to physical or mechanical connections, but may include electrical connection, either direct or indirect. Words such as "up", "down", "left", "right" and the like are only used for expressing relative positional relationship, when the absolute position of the described object is changed, the relative positional relationship may also be correspondingly changed.

For example, an inverted microstrip line structure is usually used in a liquid crystal phase shifter, that is, a liquid crystal material is filled between a microstrip line and a ground electrode, and an alignment direction of a liquid crystal molecule of the liquid crystal material is controlled by applying a bias voltage so as to change a dielectric constant of the liquid crystal material, so that a phase of a microwave changes to achieve an objective of phase shift. In order to obtain a phase shift degree as large as possible, a volume of the liquid crystal phase shifter tends to be large. Moreover, an overlapping area between the microstrip line and the ground electrode is limited; when the bias voltage is applied, the liquid crystal material at an overlapping portion between the microstrip line and the ground electrode may be effectively driven by a parallel electric field, but a situation confronted by liquid crystals on both sides of the microstrip line is more complicated, which renders a significantly larger effective cell thickness of the liquid crystal phase shifter, and adversely affects a phase shift performance.

At least one embodiment of the present disclosure provides a liquid crystal phase shifter and a fabrication method thereof, a liquid crystal antenna and an electronic device. A tubular liquid crystal phase shifter is fabricated, to reduce a volume of the liquid crystal phase shifter, improve a phase shift performance, and facilitate system integration, for example, facilitate connection with a Sub-Miniature-A (SMA) connector or a coaxial cable, and the like.

Hereinafter, the embodiments of the present disclosure will be described in detail with reference to the accompanying drawings. It should be noted that, same reference signs in different drawings are used for denoting same elements that have been described.

At least one embodiment of the present disclosure provides the liquid crystal phase shifter, comprising a first substrate, a second substrate and a liquid crystal layer. The first substrate includes a first surface and a first electrode provided on the first surface. The second substrate includes a second surface and a second electrode provided on the second surface. The liquid crystal layer is provided between the first electrode of the first substrate and the second electrode of the second substrate. The first substrate and the second substrate constitute a tubular structure in which the first substrate and the second substrate are stacked with one of the first substrate and the second substrate being inside the other of the first substrate and the second substrate.

Figure 2:
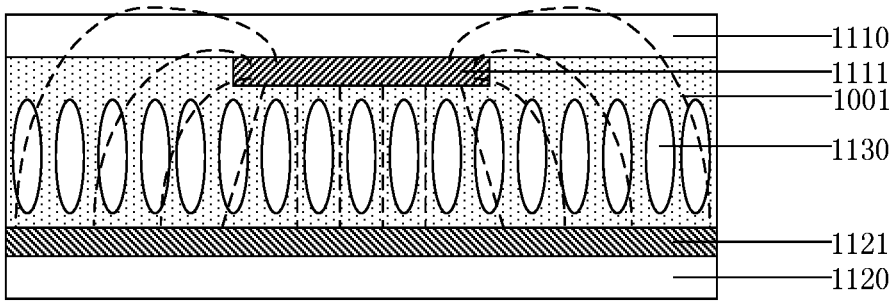
FIG. 2 is a schematic diagram of liquid crystal alignment after a bias voltage is applied to the liquid crystal phase shifter shown in FIG. 1.

FIG. 1 is a cross-sectional schematic diagram of a liquid crystal phase shifter, and FIG. 2 is a schematic diagram of liquid crystal alignment after a bias voltage is applied to the liquid crystal phase shifter shown in FIG. 1. With reference to FIG. 1 and FIG. 2, the liquid crystal phase shifter comprises a first substrate 1110, a second substrate 1120 and a liquid crystal layer 1130. The first substrate 1110 includes a first electrode 1111, and the first electrode 1111 is provided on a surface of the first substrate 1110 close to the liquid crystal layer 1130. The second substrate 1120 includes a second electrode 1121, and the second electrode 1121 is provided on a surface of the second substrate 1120 close to the liquid crystal layer 1130. The liquid crystal layer 1130 is provided between the first substrate 1110 and the second substrate 1120.

For example, the first electrode 1111 is a microstrip line, the second electrode 1121 is a ground electrode, and the liquid crystal phase shifter is of an inverted microstrip line structure. By an action of alignment layers (not shown in FIG. 1 or FIG. 2) formed on the surfaces of the first substrate 1110 and the second substrate 1120 that are opposite to each other, liquid crystal molecules in the liquid crystal layer 1130 are horizontally aligned. When a microwave signal passes through the liquid crystal phase shifter, most electric field lines 1001 pass through a short axis direction of the liquid crystal molecules, and a liquid crystal dielectric constant is $\varepsilon_{\perp}$ at this time. When a bias voltage is applied to the first electrode 1111 and the second electrode 1121, the liquid crystal molecules deflect, and most of the liquid crystal molecules change from a horizontal direction to a vertical direction; positions, directions and lengths of the electric field lines 1001 passing through the liquid crystal molecules also change, as shown in FIG. 2, and the liquid crystal dielectric constant is $\varepsilon_{11}$ at this time. A phase angle variation of the microwave signal for example is expressed by a formula below:

$$\Delta\varphi = L\frac{\omega}{c}\left(\sqrt{\varepsilon_{//}} - \sqrt{\varepsilon_{\perp}}\right)$$

Where, $\Delta\varphi$ represents the phase angle variation of the microwave signal, L represents a length of the first electrode 1111 (i.e., the microstrip line), $\omega$ represents an angular frequency of the microwave signal, c represents a light velocity, $\varepsilon_{\parallel}$ represents a dielectric constant when the liquid crystal molecules are horizontally aligned, and $\varepsilon_{\perp}$ represents a dielectric constant when the liquid crystal molecules are vertically aligned. Due to a difference between $\varepsilon_{\perp}$ and $\varepsilon_{\parallel}$, the phase of the microwave changes, so as to achieve an objective of phase modulation.

Figure 3:
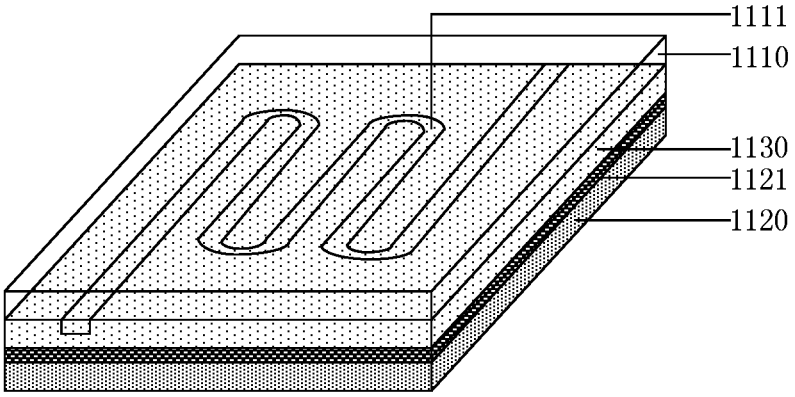
FIG. 3 is a structural schematic diagram of a liquid crystal phase shifter.

FIG. 3 is a structural schematic diagram of a liquid crystal phase shifter. With reference to FIG. 3, a stacked structure of the liquid crystal phase shifter is substantially the same as that of the liquid crystal phase shifter shown in FIG. 1 and FIG. 2, which will not be repeated here. Here, the first electrode 1111 (i.e., the microstrip line) is arranged as a C-shaped (or S-shaped) folded line, to reduce the volume of the liquid crystal phase shifter while ensuring the phase shift degree. However, the structure has a limited effect on volume reduction; when the first electrode 1111 is very long, the liquid crystal phase shifter still has a relatively large volume. Moreover, an overlapping area between the first electrode 1111 and the second electrode 1121 in a direction perpendicular to the first substrate 1110 is limited; when the bias voltage is applied to control liquid crystal molecule deflection, a portion of the liquid crystal layer 1130 at an overlapping portion between the first electrode 1111 and the second electrode 1121 may be effectively driven by the bias electric field, but a situation confronted by liquid crystals on both sides of the first electrode 1111 is more complicated, which renders a significantly larger effective cell thickness of the liquid crystal phase shifter, and adversely affects a phase shift performance.

Figure 4:
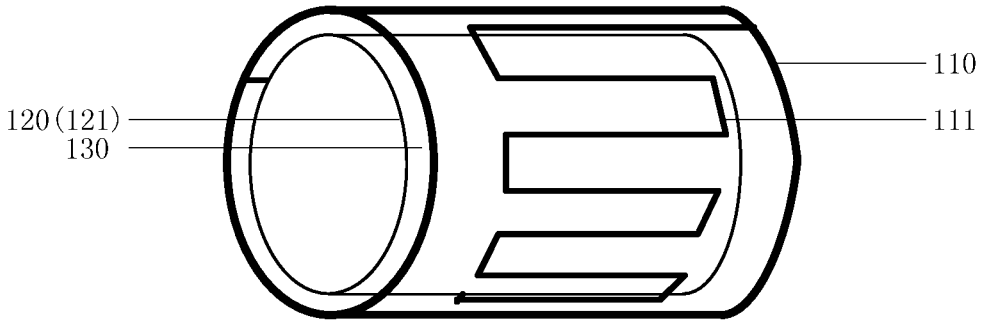
FIG. 4 is a structural schematic diagram of a liquid crystal phase shifter provided by at least one embodiment of the present disclosure.
Figure 5:
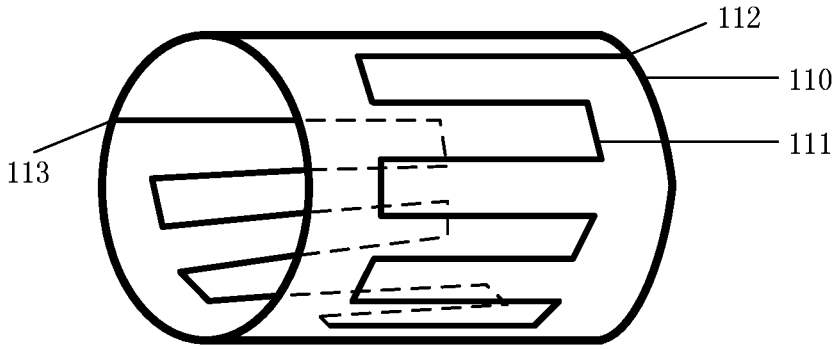
FIG. 5 is a structural schematic diagram of a first substrate of the liquid crystal phase shifter provided by at least one embodiment of the present disclosure as shown in FIG. 4.
Figure 6:
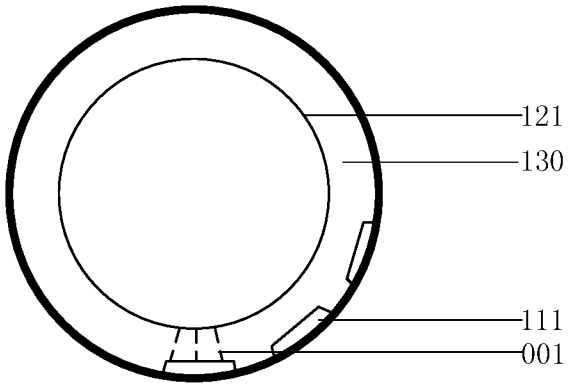
FIG. 6 is a cross-sectional schematic diagram of the liquid crystal phase shifter provided by at least one embodiment of the present disclosure as shown in FIG. 4.

FIG. 4 is a structural schematic diagram of the liquid crystal phase shifter provided by at least one embodiment of the present disclosure, FIG. 5 is a structural schematic diagram of a first substrate of the liquid crystal phase shifter provided by at least one embodiment of the present disclosure as shown in FIG. 4, and FIG. 6 is a cross-sectional schematic diagram of the liquid crystal phase shifter provided by at least one embodiment of the present disclosure as shown in FIG. 4. With reference to FIG. 4, FIG. 5 and FIG. 6, the liquid crystal phase shifter comprises a first substrate 110, a second substrate 120 and a liquid crystal layer 130. The first substrate 110 includes a first electrode 111, and the second substrate 120 includes a second electrode 121.

The first substrate 110 and the second substrate 120 are arranged in a stacked manner, function for supporting, protection, insulation, and so on, and for example is further used for avoiding electromagnetic wave leakage to reduce radiation loss of the liquid crystal phase shifter. The first substrate 110 and the second substrate 120 constitute a tubular structure in which the first substrate 110 and the second substrate 120 are stacked with one of the first substrate 110 and the second substrate 120 being inside the other of the first substrate 110 and the second substrate 120, so as to reduce a volume of the liquid crystal phase shifter, and thus, the volume is reduced with a phase shift degree unchanged, or the phase shift degree increased with the volume unchanged. Moreover, the tubular structure is conveniently connected with a cylindrical connector such as an SMA or a cylindrical coaxial cable for transmitting a microwave signal, so that an integrated device after the connection maintains a cylindrical structure the same as the connector or the coaxial cable, to facilitate system integration, which reduces a volume of the integrated device.

For example, the first substrate 110 is provided outside the second substrate 120. Of course, the embodiments of the present disclosure are not limited thereto, and an inside-outside stack relationship between the first substrate 110 and the second substrate 120 will not be limited; the first substrate 110 may be provided outside the second substrate 120, or the first substrate 110 may be provided inside the second substrate 120. In the illustrated embodiment, for example, the outside first substrate 110 is a flexible substrate, such as, a polyimide (PI) substrate, a printed circuit board (PCB) substrate, a Rogers substrate, or other applicable flexible substrate. The inside second substrate 120 for example is the above-described flexible substrate, or is a tubular or columnar metal piece.

The liquid crystal layer 130 is provided between the first electrode 111 of the first substrate 110 and the second electrode 121 of the second substrate 120. The liquid crystal layer 130 for example is made of a single liquid crystal material having large anisotropy, for example, a nematic liquid crystal, and the like; or the liquid crystal layer 130 for example is made of a mixed liquid crystal material (a mixed crystal), as long as it can function as required, which will not be limited in the embodiments of the present disclosure. For example, the liquid crystal layer 130 has a uniform thickness in a radial direction of the tubular structure, so as to have a better phase shift effect. The thickness of the liquid crystal layer 130 may be determined according to actual needs, for example, determined according to needs such as the phase shift degree, response time and an insertion loss.

A liquid crystal cell formed by the first substrate 110 and the second substrate 120 accommodates the liquid crystal layer 130, and for example is sealed with a sealant, to prevent leakage of liquid crystals. For example, in one example, the liquid crystal layer 130 is encapsulated between the first substrate 110 and the second substrate 120 with the sealant having larger deformation (for example, a flexible sealant), and after the encapsulation, the first substrate 110 and the second substrate 120 are bended, which is similar to a flexible liquid crystal display (LCD) technology. For example, in another example, the first substrate 110 and the second substrate 120 are firstly bended, and then the liquid crystal material is injected, the liquid crystal layer 130 is encapsulated. The sealant used may be the flexible sealant. The sealant used may be a non-flexible sealant, at which time, a spacer may be provided as a support at an encapsulation position, to facilitate sealing.

The first electrode 111 is provided on the first surface of the first substrate 110. The first surface is a surface of the first substrate 110 close to the liquid crystal layer 130, or is a surface of the first substrate 110 facing away from the liquid crystal layer 130, which will not be limited in the embodiments of the present disclosure. For example, in one example, the first surface is the surface of the first substrate 110 close to the liquid crystal layer 130, and in this way, the first electrode 111 is in direct contact with the liquid crystal layer 130, a distance between the first electrode 111 and the liquid crystal layer 130 is close, and the phase shift effect is good. For example, in another example, the first surface is the surface of the first substrate 110 facing away from the liquid crystal layer 130, and in this way, a fabrication process is more flexible, so that a process sequence of the first electrode 111 and the liquid crystal layer 130 is not limited.

For example, the first electrode 111 is a microstrip line, and a shape of the first electrode 111 is a folded line (for example, an S-shape or a Z-shape, etc.), or is a curved line or other applicable shape, so as to further reduce the volume of the liquid crystal phase shifter, which helps to implement miniaturization. For example, in a case where the shape of the first electrode 111 is the folded line or the curved line, the first electrode 111 includes a plurality of folded line sub-portions or curved line sub-portions, and the plurality of folded line sub-portions or curved line sub-portions as described above are sequentially connected with each other to constitute the complete folded line or curved line. For example, the plurality of folded line sub-portions or curved line sub-portions as described above are uniformly distributed around a circular arc surface of the first substrate 110, so as to effectively utilize a space of the liquid crystal phase shifter, and render a bias electric field more uniform when the bias voltage is applied. The first electrode 111 for example is made of copper, aluminum, gold, silver or an alloy thereof, or is made of other applicable conductive material. A length and a width of the first electrode 111 may be determined according to actual needs, for example, determined according to the phase shift degree and a size of the liquid crystal phase shifter.

With reference to FIG. 5, the first electrode 111 includes an input end 112 and an output end 113; and an electrical signal, for example, a microwave signal is input from the input end 112 and output from the output end 113. The input end 112 and the output end 113 are spaced apart from each other. In a case where there is no electric field between the first electrode 111 and the second electrode 121, a phase shift is fixed after the electrical signal, for example, the microwave signal is transmitted through the first electrode 111; and in a case where there is an electric field between the first electrode 111 and the second electrode 121, the phase shift changes as an intensity of the electric field changes after the electrical signal, for example, the microwave signal is transmitted through the first electrode 111.

With reference to FIG. 5, the input end 112 and the output end 113 of the first electrode 111 are both located at end portions of the tubular structure, which thus facilitates connections of the input end 112 and the output end 113 with an external structure. However, the embodiments of the present disclosure are not limited thereto, and the input end 112 and the output end 113 of the first electrode 111 may be located in any position of the tubular structure.

With reference to FIG. 5, the input end 112 of the first electrode 111 is located at a first end of the tubular structure, and the output end 113 of the first electrode is located at a second end of the tubular structure that is opposite to the first end. However, the embodiments of the present disclosure are not limited thereto, and the input end 112 and the output end 113 of the first electrode 111 may be located at a same end of the tubular structure.

With reference to FIG. 5, the first electrode 111 for example is coiled around the tubular first substrate 110 into a plurality of loops. For example, the first electrode 111 does not have portions overlapping with each other in a direction perpendicular to a central axis of the tubular structure, so as to prevent signal crosstalk.

The second electrode 121 is provided on the second surface of the second substrate 120. Similar to the associated features of the first surface, the second surface for example is a surface of the second substrate 120 close to the liquid crystal layer 130, or is a surface of the second substrate 120 facing away from the liquid crystal layer 130, which will not be limited in the embodiments of the present disclosure. For example, in a case where the second surface is the surface of the second substrate 120 close to the liquid crystal layer 130 and the first surface is the surface of the first substrate 110 close to the liquid crystal layer 130, that is, the liquid crystal layer 130 is distributed between the first surface and the second surface, the liquid crystal phase shifter has a better phase shift effect and an excellent phase shift performance.

For example, the second electrode 121 is a ground electrode, which is electrically connected with a signal ground (VSS). For example, the second electrode 121 covers an entirety of the second surface, in which manner the insertion loss is reduced. Of course, the embodiments of the present disclosure are not limited thereto, and the second electrode 121 for example covers only a portion of the second surface, which may be determined according to actual needs. The second electrode 121 for example is made of copper, aluminum, gold, silver or an alloy thereof, or is made of other applicable conductive material.

For example, the second substrate 120 is a metal piece, in this case, the second electrode 121 is regarded as being integrally formed with the second substrate 120, which simplifies a process and improves strength of the liquid crystal phase shifter.

The first substrate 110 having the first electrode 111 on the first surface thereof and the second substrate 120 having the second electrode 121 on the second surface thereof constitute the tubular structure in which the first substrate 110 and the second substrate 120 are stacked with one of the first substrate 110 and the second substrate 120 being inside the other of the first substrate 110 and the second substrate 120, such that the liquid crystal layer 130 is sandwiched between the first electrode 111 and the second electrode 121 in terms of an electrical structure, so as to implement the function of the liquid crystal phase shifter especially when the first electrode 111 and the second electrode 121 are applied with the electrical signal.

For example, a shape of the tubular structure of the liquid crystal phase shifter is a tubular structure with a circular cross section, a tubular structure with an elliptical cross section or other applicable shape. For example, in one example, the shape of the tubular structure is the tubular structure with the circular cross section, and a cross-sectional schematic diagram thereof is as shown in FIG. 6. In the structure, the liquid crystal layer 130 is formed in a circular arc shape or a circular ring shape, which is favorable for the liquid crystal layer 130 to maintain a uniform cell thickness. Moreover, if the bias voltage is applied, the bias electric field between the first electrode 111 and the second electrode 121 is more uniform, so that a deflection angle of the liquid crystal molecule is more accurate and the phase shift effect is better.

For example, the first electrode 111 is the microstrip line, the second electrode 121 is the ground electrode, the first electrode 111 and the second electrode 121 are used for providing a transmission channel for the microwave signal, and the first electrode 111 and the second electrode 121 constitute an inverted microstrip line structure; however, the embodiments of the present disclosure are not limited thereto, and the first electrode 111 and the second electrode 121 may be of an ordinary microstrip line structure, a suspended microstrip line structure, and any other applicable structure. For example, the liquid crystal phase shifter is fabricated by using a fabrication technology similar to the flexible display, in which wiring and cell forming are performed on the flexible substrate and then bending is performed. Of course, the embodiments of the present disclosure are not limited thereto, and the liquid crystal phase shifter may be fabricated by using any applicable process.

Figure 7:
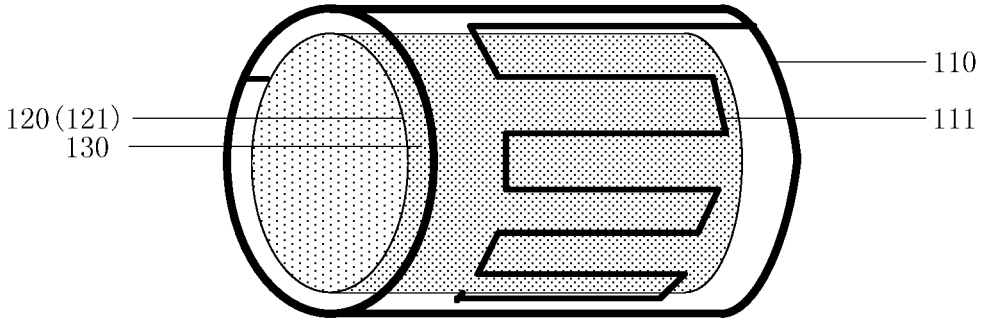
FIG. 7 is a structural schematic diagram of another liquid crystal phase shifter provided by at least one embodiment of the present disclosure.

FIG. 7 is a structural schematic diagram of another liquid crystal phase shifter provided by at least one embodiment of the present disclosure. With reference to FIG. 7, except for arrangement modes of the second substrate 120 and the second electrode 121, the liquid crystal phase shifter according to this embodiment is substantially the same as the liquid crystal phase shifter as described in FIG. 4. In this embodiment, the second substrate 120 and the second electrode 121 are integrally formed into a metal tube, which thus simplifies the fabrication process and improves strength of the liquid crystal phase shifter. For example, the metal tube is a hollow structure. The metal tube (the second substrate 120) for example is provided inside or outside the first substrate 110, which will not be limited in the embodiments of the present disclosure. The metal tube for example is made of copper, aluminum, gold, silver or an alloy thereof, or is made of other applicable conductive material.

Of course, a specific structure of the metal piece integrally formed of the second substrate 120 and the second electrode 121 will not be limited; for example, in other example, the second substrate 120 and the second electrode 121 are integrally formed into a metal column, in which way it is much easier to fabrication. The metal column for example is a hollow structure or a solid structure. If the metal column is the solid structure, it is necessary to provide the metal column (the second substrate 120) inside the first substrate 110.

Figure 8:
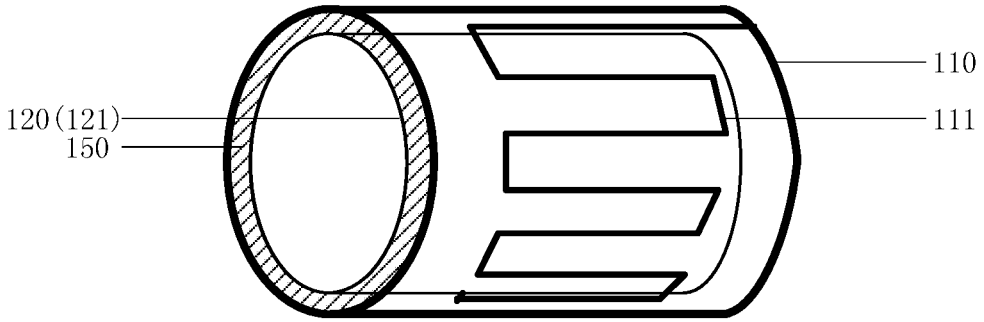
FIG. 8 is a structural schematic diagram of another liquid crystal phase shifter provided by at least one embodiment of the present disclosure.

FIG. 8 is a structural schematic diagram of another liquid crystal phase shifter provided by at least one embodiment of the present disclosure. With reference to FIG. 8, except that a flexible sealant 150 is further provided, the liquid crystal phase shifter according to this embodiment is substantially the same as the liquid crystal phase shifter as described in FIG. 4. In this embodiment, the flexible sealant 150 is provided at both ends of the tubular structure of the liquid crystal phase shifter (the flexible sealant 150 at one of the ends is shown in FIG. 8), and is located between the first substrate 110 and the second substrate 120. The flexible sealant 150 is provided to prevent the liquid crystals of the liquid crystal layer 130 from leaking. The flexible sealant 150 for example is a photocurable adhesive having larger deformation, which for example is any applicable organic or inorganic material.

For example, in one example, a process sequence is: firstly encapsulating the liquid crystal layer 130, and then processing to obtain the tubular structure, that is, firstly encapsulating the liquid crystal layer 130 in the liquid crystal cell formed by the first substrate 110 and the second substrate 120 by using the flexible sealant 150, and after the encapsulation, bending the first substrate 110 and the second substrate 120. The technology is similar to the flexible LCD technology, and for example shares a same production line and production facility with the flexible LCD technology, to reduce production costs. Of course, the embodiments of the present disclosure are not limited thereto, and the process sequence for example is: firstly fabricating the tubular structure, and then encapsulating the liquid crystal layer 130, that is, firstly bending the first substrate 110 and the second substrate 120 to obtain the tubular structure, then injecting the liquid crystal material into the liquid crystal cell formed by the first substrate 110 and the second substrate 120, and then, encapsulating the liquid crystal layer 130 by the sealant. The sealant used for example is the flexible sealant 150. The sealant used for example is the non-flexible sealant, at which time, the spacer for example is provided as the support at the encapsulation position, to facilitate sealing.

It should be noted that, in respective embodiments of the present disclosure, an encapsulation mode of the liquid crystal layer 130 will not be limited; for example, in other example, the first substrate 110 and the second substrate 120 are integrally connected with each other, to fabricate the double-layered tubular structure having a gap, so that the flexible sealant 150 is omitted, and an objective to prevent the liquid crystal layer 130 from leaking is achieved with the structure of the first substrate 110 and the second substrate 120 per se.

Figure 9:
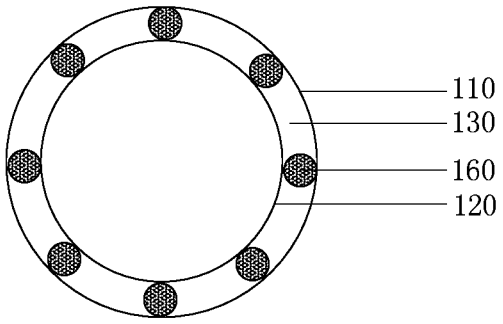
FIG. 9 is a cross-sectional schematic diagram of another liquid crystal phase shifter provided by at least one embodiment of the present disclosure.

FIG. 9 is a cross-sectional schematic diagram of another liquid crystal phase shifter provided by at least one embodiment of the present disclosure. With reference to FIG. 9, except that a spacer 160 is further comprised, the liquid crystal phase shifter according to this embodiment is substantially the same as the liquid crystal phase shifter as described in FIG. 4, FIG. 5 and FIG. 6. In this embodiment, a plurality of spacers 160 abut between the first substrate 110 and the second substrate 120, and are distributed in the liquid crystal layer 130. The spacers 160 function for supporting the liquid crystal cell, maintaining the cell thickness, and so on. The spacers 160 for example are columnar spacers, or are spherical spacers, and these spherical spacers are, for example, resin balls, silicon balls or other applicable materials. The number of spacers 160 may be determined according to actual needs.

Figure 10:
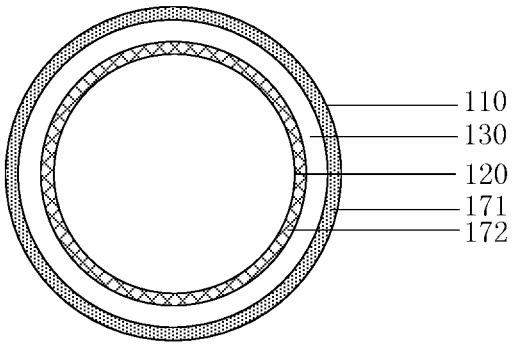
FIG. 10 is a cross-sectional schematic diagram of another liquid crystal phase shifter provided by at least one embodiment of the present disclosure.

FIG. 10 is a cross-sectional schematic diagram of another liquid crystal phase shifter provided by at least one embodiment of the present disclosure. With reference to FIG. 10, except that a first alignment layer 171 and a second alignment layer 172 are further comprised, the liquid crystal phase shifter according to this embodiment is substantially the same as the liquid crystal phase shifter as described in FIG. 4, FIG. 5 and FIG. 6. In this embodiment, the first alignment layer 171 and the second alignment layer 172 are respectively provided on surfaces of the first substrate 110 and the second substrate 120 that are opposite to each other. That is, the first alignment layer 171 is provided between the first substrate 110 and the liquid crystal layer 130, and the second alignment layer 172 is provided between the second substrate 120 and the liquid crystal layer 130.

The first alignment layer 171 and the second alignment layer 172 are used for controlling an initial deflection direction of liquid crystal molecules. For example, the first alignment layer 171 and the second alignment layer 172 are made of an organic material such as polyimide, and processed and treated in a mode such as friction and illumination to obtain an alignment characteristic. Of course, the embodiments of the present disclosure are not limited thereto, and other components or devices may also be used for controlling the initial deflection direction of the liquid crystal molecules.

Figure 11:
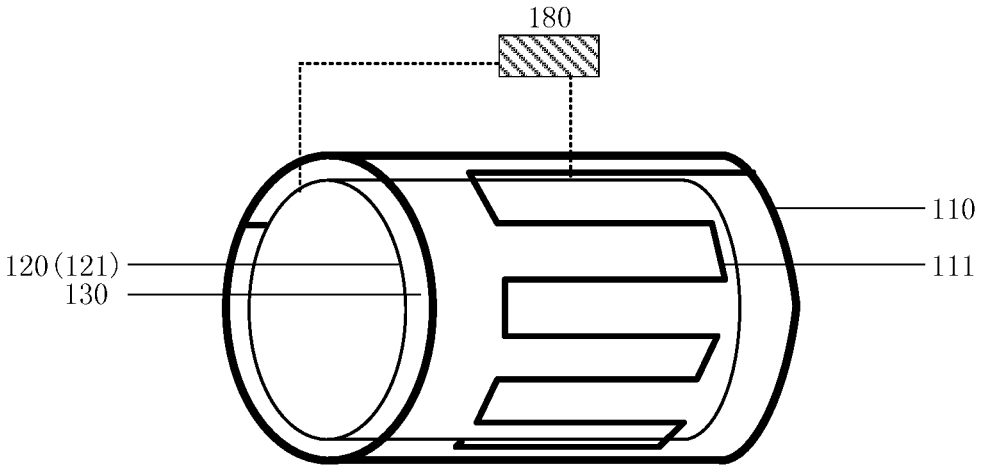
FIG. 11 is a structural schematic diagram of another liquid crystal phase shifter provided by at least one embodiment of the present disclosure.

FIG. 11 is a structural schematic diagram of another liquid crystal phase shifter provided by at least one embodiment of the present disclosure. With reference to FIG. 11, except that a bias voltage source 180 is further comprised, the liquid crystal phase shifter according to this embodiment is substantially the same as the liquid crystal phase shifter as described in FIG. 4. In this embodiment, the first electrode 111 and the second electrode 121 not only transmit the microwave signal, but also are configured to be connected with the bias voltage source 180 to provide the liquid crystal layer 130 with the bias electric field. As shown in FIG. 6, electric field lines are divergent along radial directions of the tubular structure of the liquid crystal phase shifter.

For example, the first electrode 111 and the second electrode 121 are electrically connected with the bias voltage source 180 through an electrical line. For example, the bias voltage source 180 is a numerical control voltage source or other applicable device. The bias voltage source 180 for example is provided outside the liquid crystal phase shifter, or is connected with the first substrate 110 or the second substrate 120 in a manner such as adhering and clamping, which will not be limited in the embodiments of the present disclosure. By controlling a voltage output from the bias voltage source 180, liquid crystal molecules in the liquid crystal layer 130 are made to deflect, so as to further change an effective phase shift constant of the electromagnetic wave propagating in the liquid crystal phase shifter, and implement control of the phase of the output microwave signal.

At least one embodiment of the present disclosure further provides an electronic device, comprising the liquid crystal phase shifter provided by any one embodiment of the present disclosure. The electronic device has advantages such as a small volume and a good phase shift performance, which facilitates system integration, for example, facilitates connection with the SMA connector or the coaxial cable, and the like.

Figure 12:
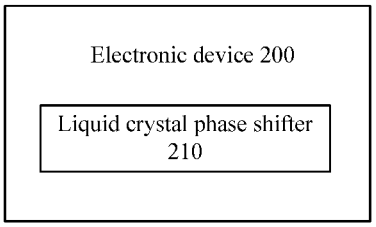
FIG. 12 is a schematic block diagram of an electronic device provided by at least one embodiment of the present disclosure.

FIG. 12 is a schematic block diagram of the electronic device provided by at least one embodiment of the present disclosure. With reference to FIG. 12, the electronic device 200 comprises the liquid crystal phase shifter 210. The liquid crystal phase shifter 210 is the liquid crystal phase shifter provided by any one embodiment of the present disclosure. The electronic device 200 for example is a radar system, an accelerator, a communication base station instrument, and any other device including the liquid crystal phase shifter, which will not be limited in the embodiments of the present disclosure. The electronic device 200 may further comprise more components, and connection relationships between the respective components and the liquid crystal phase shifter 210 will not be limited.

At least one embodiment of the present disclosure further provides a liquid crystal antenna, comprising the first substrate, the second substrate, the liquid crystal layer and a radiator portion. The first substrate includes the first surface and the first electrode provided on the first surface. The second substrate includes the second surface and the second electrode provided on the second surface. The liquid crystal layer is provided between the first substrate and the second substrate. The radiator portion is provided on the second substrate. The first substrate and the second substrate constitute the tubular structure in which the first substrate and the second substrate are stacked with one of the first substrate and the second substrate being inside the other of the first substrate and the second substrate. The liquid crystal antenna has a small volume and a phase shift function, and facilitates system integration, for example, facilitates connection with the Sub-Miniature-A (SMA) connector or the coaxial cable, and the like.

Figure 13:
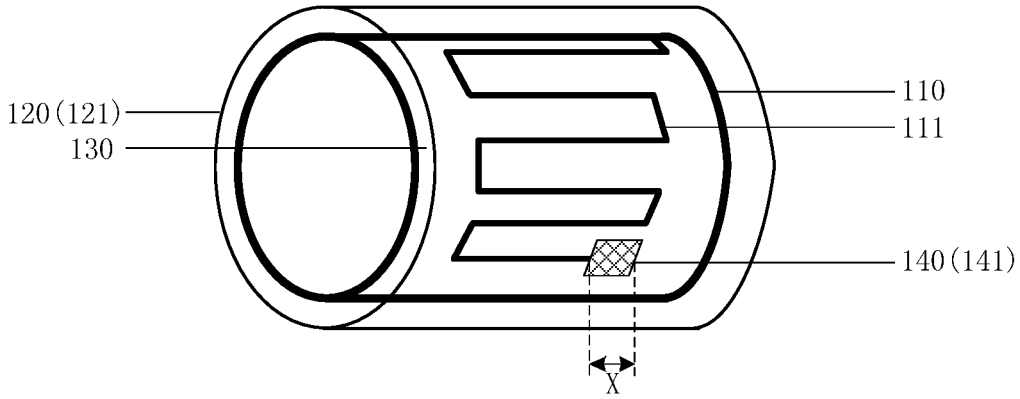
FIG. 13 is a structural schematic diagram of a liquid crystal antenna provided by at least one embodiment of the present disclosure.

FIG. 13 is a structural schematic diagram of the liquid crystal antenna provided by at least one embodiment of the present disclosure. With reference to FIG. 13, the liquid crystal antenna comprises the first substrate 110, the second substrate 120, the liquid crystal layer 130 and the radiator portion 140. Associated technical features of the first substrate 110, the second substrate 120 and the liquid crystal layer 130 of the liquid crystal antenna are substantially the same as those of the corresponding structures of the liquid crystal phase shifter as described in FIG. 4, which will not be repeated here. For example, the radiator portion 140 couples with the electrical signal, for example, the microwave signal transmitted through the first electrode 111 and radiates the electrical signal, for example, the microwave signal.

For example, the second electrode 121 includes an opening 141. The opening 141 for example has a shape of a rectangle, a square, a circle, or other applicable shape, which will not be limited in the embodiments of the present disclosure. For example, the second electrode 121 covers the second surface of the second substrate 120, but the second electrode 121 no longer covers at a position of the opening 141.

In order to facilitate transmission of the microwave signal through the opening 141, the first substrate 110 is provided inside the second substrate 120, that is, the second substrate 120 is located outside, and the opening 141 is also located outside the tubular structure. For example, in a case where the second substrate 120 is made of metal, it is also necessary to provide an opening at a position of the second substrate 120 corresponding to the opening 141. For example, the opening 141 overlaps with the output end 113 of the first electrode 111 in the direction perpendicular to the central axis of the tubular structure, to facilitate transmission of the microwave signal through the opening 141.

For example, the radiator portion 140 is provided at a position on the second substrate 120 corresponding to the opening 141 (the radiator portion 140 overlaps with the opening 141), and the radiator portion 140 is insulated from the second electrode 121. For example, the radiator portion 140 is a resonant microstrip patch antenna, a dual-frequency patch antenna, or other component, which will not be described here in detail. For example, the radiator portion 140 is a metal sheet. For example, the radiator portion 140 has a shape of a square, a side length X of the square is about half of a wavelength of the microwave signal transmitted by the liquid crystal antenna, to meet requirements of the liquid crystal antenna working frequency band.

At least one embodiment of the present disclosure further provides an electronic device, comprising the liquid crystal antenna provided by any one embodiment of the present disclosure. The electronic device has advantages of a small volume and a phase shift function, and facilitates system integration, for example, facilitates connection with the SMA connector or the coaxial cable, and the like.

Figure 14:
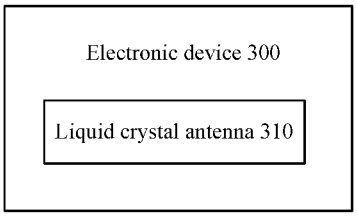
FIG. 14 is a schematic block diagram of another electronic device provided by at least one embodiment of the present disclosure.

FIG. 14 is a schematic block diagram of another electronic device provided by at least one embodiment of the present disclosure. With reference to FIG. 14, the electronic device 300 comprises the liquid crystal antenna 310. The liquid crystal antenna 310 is the liquid crystal antenna provided by any one embodiment of the present disclosure. The electronic device 300 may be the radar system, the accelerator, the communication base station instrument, or any other device including the liquid crystal antenna, which will not be limited in the embodiments of the present disclosure. The electronic device 300 may further comprise more components, and connection relationships between the respective components and the liquid crystal antenna 310 will not be limited.

At least one embodiment of the present disclosure further provides a fabrication method of a liquid crystal phase shifter, comprising: providing the first substrate, in which the first electrode is formed on the first surface of the first substrate; providing the second substrate, in which the second electrode is formed on the second surface of the second substrate; bonding the first substrate and the second substrate to form the liquid crystal cell of the tubular structure, and filling the liquid crystal layer in the liquid crystal cell, in which the liquid crystal layer is located between the first electrode and the second electrode. The method may be used for fabricating the liquid crystal phase shifter according to any one embodiment as described above, and the liquid crystal phase shifter has advantages such as a small volume and a good phase shift performance, and facilitates system integration, for example, facilitates connection with the SMA connector or the coaxial cable, and the like.

Figure 15:
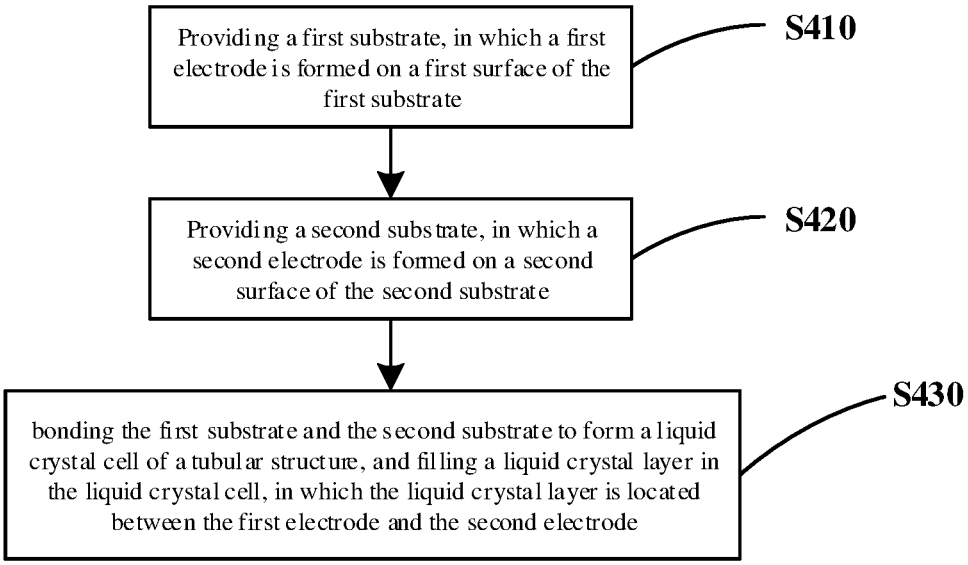
FIG. 15 is a flow chart of a fabrication method of a liquid crystal phase shifter provided by at least one embodiment of the present disclosure.

FIG. 15 is a flow chart of the fabrication method of the liquid crystal phase shifter provided by at least one embodiment of the present disclosure. With reference to FIG. 15, the method comprises steps of:

Step S410: providing the first substrate 110, in which the first electrode 111 is formed on the first surface of the first substrate 110;

Step S420: providing the second substrate 120, in which the second electrode 121 is formed on the second surface of the second substrate 120;

Step S430: bonding the first substrate 110 and the second substrate 120 to form the liquid crystal cell of the tubular structure, and filling the liquid crystal layer 130 in the liquid crystal cell, in which the liquid crystal layer 130 is located between the first electrode 111 and the second electrode 121.

For example, in one example, step S430 includes:

Filling the liquid crystal layer 130 between the first substrate 110 and the second substrate 120 and encapsulating the liquid crystal layer 130; and Bending the liquid crystal cell formed by the first substrate 110, the second substrate 120 and the liquid crystal layer 130 into the tubular structure.

The fabrication method is similar to the fabrication method of the flexible LCD, and may share the same production line and production facility therewith, to reduce production costs.

For example, in another example, step S430 includes:

Bending the first substrate 110 and the second substrate 120 into the tubular structure;

Filling the liquid crystal layer 130 between the first substrate 110 and the second substrate 120 and encapsulating the liquid crystal layer 130.

The fabrication method for example has the liquid crystal layer 130 encapsulated with an ordinary sealant, which has no requirement for flexibility of the sealant, and is easy to implement.

It should be noted that, in the respective embodiments of the present disclosure, the fabrication method of the liquid crystal phase shifter will not be limited to the steps and the order as described above, and may further comprise more or fewer steps, and an order between the respective steps may be determined according to actual needs.

Several points below need to be explained:

(1) The drawings of the embodiments of the present disclosure relate only to the structures involved in the embodiments of the present disclosure, and normal designs may be referred to for other structures.

(2) In case of no conflict, the embodiments of the present disclosure and the features in the embodiments may be combined with each other to obtain a new embodiment.

The above are only specific embodiments of the present disclosure, but the scope of the embodiments of the present disclosure is not limited thereto, and the scope of the present disclosure should be the scope of the following claims.

The invention claimed is:

1. A liquid crystal phase shifter, comprising:

a first substrate, including a first surface and a first electrode provided on the first surface;

a second substrate, including a second surface and a second electrode provided on the second surface; and a liquid crystal layer, provided between the first substrate and the second substrate, wherein, the first substrate and the second substrate are stacked with one of the first substrate and the second substrate having a tubular structure and the other of the first substrate and the second substrate being provided inside the tubular structure and being surrounded by the tubular structure; and in a direction perpendicular to a central axis of the tubular structure, the liquid crystal layer is provided between the first electrode and the second electrode.

2. The liquid crystal phase shifter according to claim 1, wherein, the first electrode is a microstrip line, and the second electrode is a ground electrode.

3. The liquid crystal phase shifter according to claim 1, wherein, the first electrode includes a plurality of folded line sub electrodes or curved line sub electrodes, and the plurality of folded line sub electrodes or curved line sub electrodes are uniformly distributed around a circular arc surface of the first substrate.

4. The liquid crystal phase shifter according to claim 1, wherein, the second substrate and the second electrode are integral into a metal tube.

5. The liquid crystal phase shifter according to claim 1, wherein, the second substrate and the second electrode are integral into a metal column, and the second substrate is provided inside the first substrate.

6. The liquid crystal phase shifter according to claim 1, wherein, the first substrate and/or the second substrate are flexible substrates.

7. The liquid crystal phase shifter according to claim 1, further comprising a plurality of spacers, wherein, the spacers abut between the first substrate and the second substrate, and are distributed in the liquid crystal layer.

8. The liquid crystal phase shifter according to claim 1, further comprising a flexible sealant, wherein, the flexible sealant is provided at both ends of the tubular structure and is located between the first substrate and the second substrate.

9. The liquid crystal phase shifter according to claim 1, wherein, the liquid crystal layer has a uniform thickness.

10. An electronic device, comprising the liquid crystal phase shifter according to claim 1.

11. A liquid crystal antenna, comprising:

a first substrate, including a first surface and a first electrode provided on the first surface;

a second substrate, including a second surface and a second electrode provided on the second surface;

a liquid crystal layer, provided between the first substrate and the second substrate; and a radiator portion, provided on the second substrate, wherein, the first substrate and the second substrate are stacked with one of the first substrate and the second substrate having a tubular structure and the other of the first substrate and the second substrate being provided inside the tubular structure and being surrounded by the tubular structure; and in a direction perpendicular to a central axis of the tubular structure, the liquid crystal layer is provided between the first electrode and the second electrode.

12. The liquid crystal antenna according to claim 11, wherein, the second electrode includes an opening, the opening overlaps with the first electrode in a direction perpendicular to a central axis of the tubular structure, and the first substrate is located inside the second substrate.

13. The liquid crystal antenna according to claim 12, wherein, the radiator portion overlaps with the opening.

14. The liquid crystal antenna according to claim 12, wherein, the opening overlaps with an output end of the first electrode in the direction perpendicular to the central axis of the tubular structure.

15. The liquid crystal antenna according to claim 11, wherein, the radiator portion is insulated from the second electrode.

16. The liquid crystal antenna according to claim 11, wherein, the radiator portion has a shape of a square, and a side length of the square is about half of a wavelength of a microwave signal transmitted by the liquid crystal antenna.

17. An electronic device, comprising the liquid crystal antenna according to claim 11.

* * * * *